US007218062B1

(12) United States Patent
Wang et al.

(10) Patent No.: US 7,218,062 B1
(45) Date of Patent: May 15, 2007

(54) PROTECTIVE DEVICE AND A CCFL DRIVING SYSTEM USED THEREON

(75) Inventors: Jeng-Shong Wang, Taipei County (TW); Lien-Sung Tseng, Taipei County (TW)

(73) Assignee: Lien Chang Electronic Enterprise Co., Ltd., Taipei County (TW)

( * ) Notice: Subject to any disclaimer, the term of this patent is extended or adjusted under 35 U.S.C. 154(b) by 0 days.

(21) Appl. No.: 11/409,978

(22) Filed: Apr. 25, 2006

(51) Int. Cl.
*H05B 37/02* (2006.01)

(52) U.S. Cl. ..... 315/225; 315/126; 315/DIG. 5

(58) Field of Classification Search ..... 315/225, 315/119, 125, 126, DIG. 5
See application file for complete search history.

(56) References Cited

U.S. PATENT DOCUMENTS 6,087,776 A * 7/2000 Yamashita et al. ..... 315/82

6,710,551 B2 * 3/2004 Mita et al. ..... 315/209 R

* cited by examiner

*Primary Examiner*—David Vu
(74) *Attorney, Agent, or Firm*—Rosenberg, Klein & Lee

(57) ABSTRACT

A protective device and a CCFL driving system using the same are provided. The protective device employs a short detecting circuit to receive a high AC power at the high terminal of the CCFL through a step-down capacitor. The protective device outputs a short-circuit protective signal during a shorting event. A rectified diode receives high AC power through the step-down capacitor, and outputs high DC power. A first charging capacitor couples with the rectified diode, and generates a detecting voltage in response to the high DC power. An open detecting circuit, having a threshold, couples with the first charging capacitor. The open detecting circuit outputs an open-circuit protective signal when the detecting voltage is over the threshold. The protective device of the present invention has a lighting voltage-limited circuit, which couples with the first charging capacitor. The lighting voltage-limited circuit receives the detecting voltage, and outputs an over-voltage protective signal.

28 Claims, 6 Drawing Sheets

PROTECTIVE DEVICE AND A CCFL DRIVING SYSTEM USED THEREON

BACKGROUND OF THE INVENTION

1. Field of the Invention

The present invention relates to a protective device and a CCFL driving system used thereon, and more particularly to a protective signal outputted to a control circuit according to a high AC power detected in the high-voltage terminal of a CCFL of the claimed system. The outputted protective signal is used for protecting the control circuit, the protective device of the CCFL, and the CCFL driving system.

2. Description of Related Art

A CCFL (Cold Cathode Fluorescent Lamp) is used as a light source for the backlight module in a LCD panel. CCFLs are driven by a driving circuit such as an inverter. The size of LCD panels are increasing due to progressive technical developments and consumer demand, so that now it is common for two or more CCFLs to be used for illuminating the panel.

In general, a set of the inverters can only light one or two CCFLs, but more inverters are required for driving a plurality of CCFLs as used for a large-sized LCD panel or a large TV LCD screen. Correspondingly, the plural protective circuits are required to protect the inverters and the CCFLs. As such, the cost to manufacture the LCD panel is increasing as well. Additionally, the protective circuit of the conventional scheme is complicated and the circuitry thereof is becoming increasingly complex.

SUMMARY OF THE INVENTION

Other than the illustrated prior art, the present invention provides a protective device and a CCFL driving system, wherein the protective device improves upon the mentioned drawback. The claimed invention uses high AC power of the high-voltage terminal of the CCFL for protection in an open/short state and under a lighting voltage-limited situation. Furthermore, the claimed invention effectively provides suitable protection if the CCFL is broken.

The protective device of the present invention has a short detecting circuit, a rectified diode, a first charging capacitor, an open detecting circuit, and a lighting voltage-limited circuit. In the protective device, the short detecting circuit couples with a high terminal of the CCFL and a power supply through a step-down capacitor, wherein the short detecting circuit receives a high AC power and outputs a short-circuit protective signal to the control circuit when a shorting event occurs to the CCFL; the rectified diode couples with the high terminal of the CCFL through a step-down capacitor, wherein the rectified diode rectifies the high AC power and outputs a high DC power; the first charging capacitor couples with the rectified diode, wherein the first charging circuit generates a detecting voltage based on the high DC power; the open detecting circuit couples with the first charging capacitor and has a threshold, wherein the open detecting circuit outputs an open-circuit protective signal to the control circuit when the detecting voltage is greater than the threshold; and the lighting voltage-limited circuit couples with the first charging capacitor and receives the detecting voltage, and outputs an over-voltage protective signal to the control circuit.

The CCFL driving system of the present invention has a lamp current equalizer, a lighting voltage-limited circuit, an open detecting circuit, a short detecting circuit, an overload detecting circuit, a brightness regulating circuit, a current detecting circuit, and an ON/OFF control device, wherein the CCFL driving system of a LCD panel drives a plurality of CCFLs simultaneously by utilizing an active electro-stabilizer or a DC/high-frequency AC converter through a transformer.

BRIEF DESCRIPTION OF THE DRAWINGS

The foregoing aspects and many of the attendant advantages of this invention will be more readily appreciated as the same becomes better understood by reference to the following detailed description, when taken in conjunction with the accompanying drawings, wherein.

DETAILED DESCRIPTION OF THE PREFERRED EMBODIMENTS

The present invention is illustrated with a preferred embodiment and attached drawings. However, the invention is not intended to be limited thereby.

Figure 1:
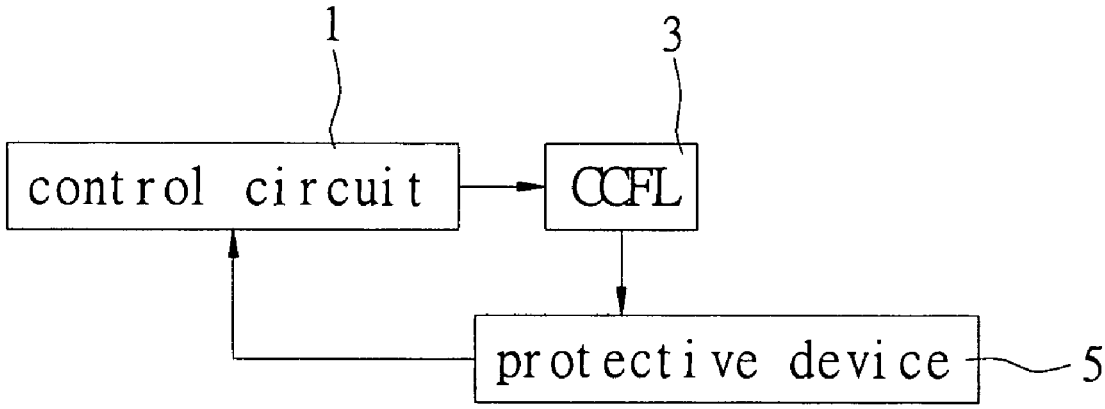
FIG. 1 is a schematic view of a CCFL driving system of the present invention.

Reference is made to FIG. 1, which shows a schematic diagram of a CCFL (Cold Cathode Fluorescent Lamp) driving system provided in the present invention. The CCFL driving system includes a control circuit 1, a CCFL 3 and a protective device 5 of the claimed invention. The protective device 5 outputs a variety of protective signals to the control circuit 1 as the CCFL 3 reaches a point of failure, in the meantime, the control circuit 1 can protect the CCFL 3 itself according to the various protective signals.

Figure 2:
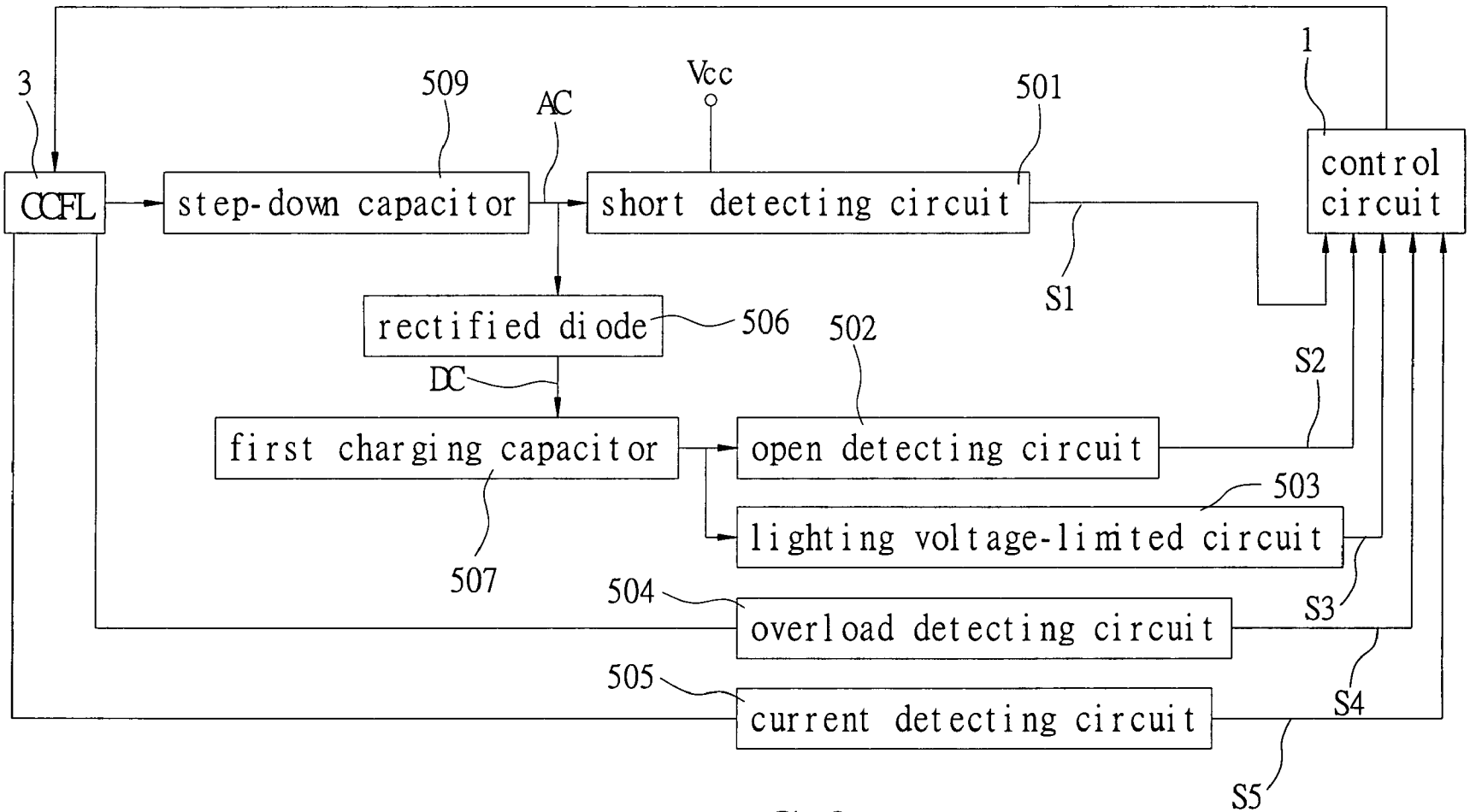
FIG. 2 is a schematic circuitry used on the CCFL driving system of the first preferred embodiment of the present invention.

FIG. 2 shows a circuitry block diagram of the CCFL driving system of the first preferred embodiment. In this first embodiment, the protective device 5 has a short detecting circuit 501, a rectified diode 506, a first charging capacitor 507, an open detecting circuit 502, and a lighting voltage-limited circuit 503.

Referring to the FIG. 2 again, the short detecting circuit 501 of the protective device 5 couples with a high terminal of the CCFL 3 and a power supply Vcc through a step-down capacitor 509. The short detecting circuit 501 outputs a short-circuit protective signal S1 to the control circuit 1 as the high terminal of the CCFL 3 receives a high AC power (AC) and a shorting event occurs to the CCFL 3.

Moreover, the rectified diode 506 couples with the high terminal of the CCFL 3 via a step-down capacitor 509, wherein the rectified diode 506 is used to rectify the high AC power (AC), and outputs a high DC power (DC). The first charging capacitor 507 couples with the rectified diode 506, and the first charging capacitor 507 generates a detecting voltage based on the above high DC power. The open detecting circuit 502 couples with the first charging capacitor 507 and the control circuit 1. The open detecting circuit 502 has a threshold, and the open detecting circuit 502 outputs an open-circuit protective signal S2 to the control circuit 1 when the detecting voltage is greater than the threshold. The lighting voltage-limited circuit 503 couples with the first charging capacitor 507 and the control circuit 1. Furthermore, the lighting voltage-limited circuit 503 receives the detecting voltage, and outputs an over-voltage protective signal S3 to the control circuit 1.

FIG. 2 also shows a protective device 5 further having an overload detecting circuit 504 and a current detecting circuit 505. The overload detecting circuit 504 outputs an overload protective signal S4 to the control circuit 1 in response to the current flowing across the CCFL 3. The current detecting circuit 505 outputs a power regulating signal S5 to the control circuit 1 in response to the current flowing across the CCFL 3. Moreover, the signals, such as the previously mentioned S1, S2, S3, S4 and S5, outputted from the short detecting circuit 501, the open detecting circuit 502, the lighting voltage-limited circuit 503, the overload detecting circuit 504 and the current detecting circuit 505 of the protective device 5 of the present invention are transmitted into the control circuit 1 via an electro-optical coupler (not shown in the diagram) or a PCB copper-foil (not shown in the diagram).

Figure 3:
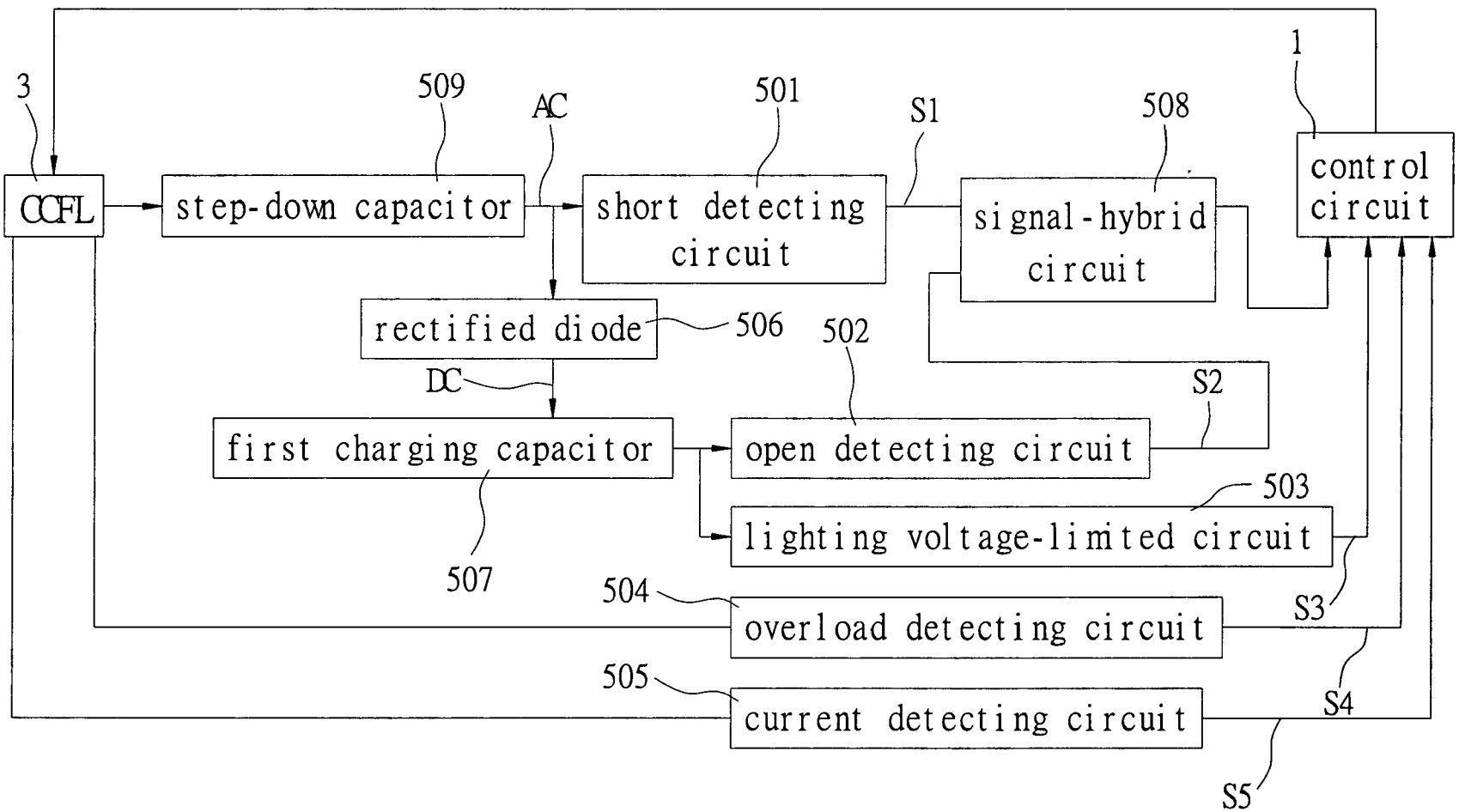
FIG. 3 is a circuit block diagram of the CCFL driving system of the second preferred embodiment of the present invention.

In view of FIG. 2, and referring to FIG. 3, which shows the second embodiment of the present invention illustrating the circuitry block diagram of the CCFL driving system, compared with the first preferred embodiment, the protective device 5 of the second preferred embodiment further includes a signal-hybrid circuit 508. The signal-hybrid circuit 508 couples with the control circuit 1 and a contact between the short detecting circuit and the open detecting circuit. Next, the signal-hybrid circuit 508 receives the short-circuit protective signal S1 and the open-circuit protective signal S2, and outputs the open/short-circuit protective signal S6 to the control circuit 1. In the second embodiment of the present invention, the signals, such as the previously mentioned S3, S4, S5 and S6, outputted from the lighting voltage-limited circuit 503 of the protective device 5, the overload detecting circuit 504, the current detecting circuit 505 and the signal-hybrid circuit 508 can be transmitted to the control circuit 1 via the electro-optical coupler (not shown in the diagram) or the PCB copper-foil (now shown).

Figure 4:
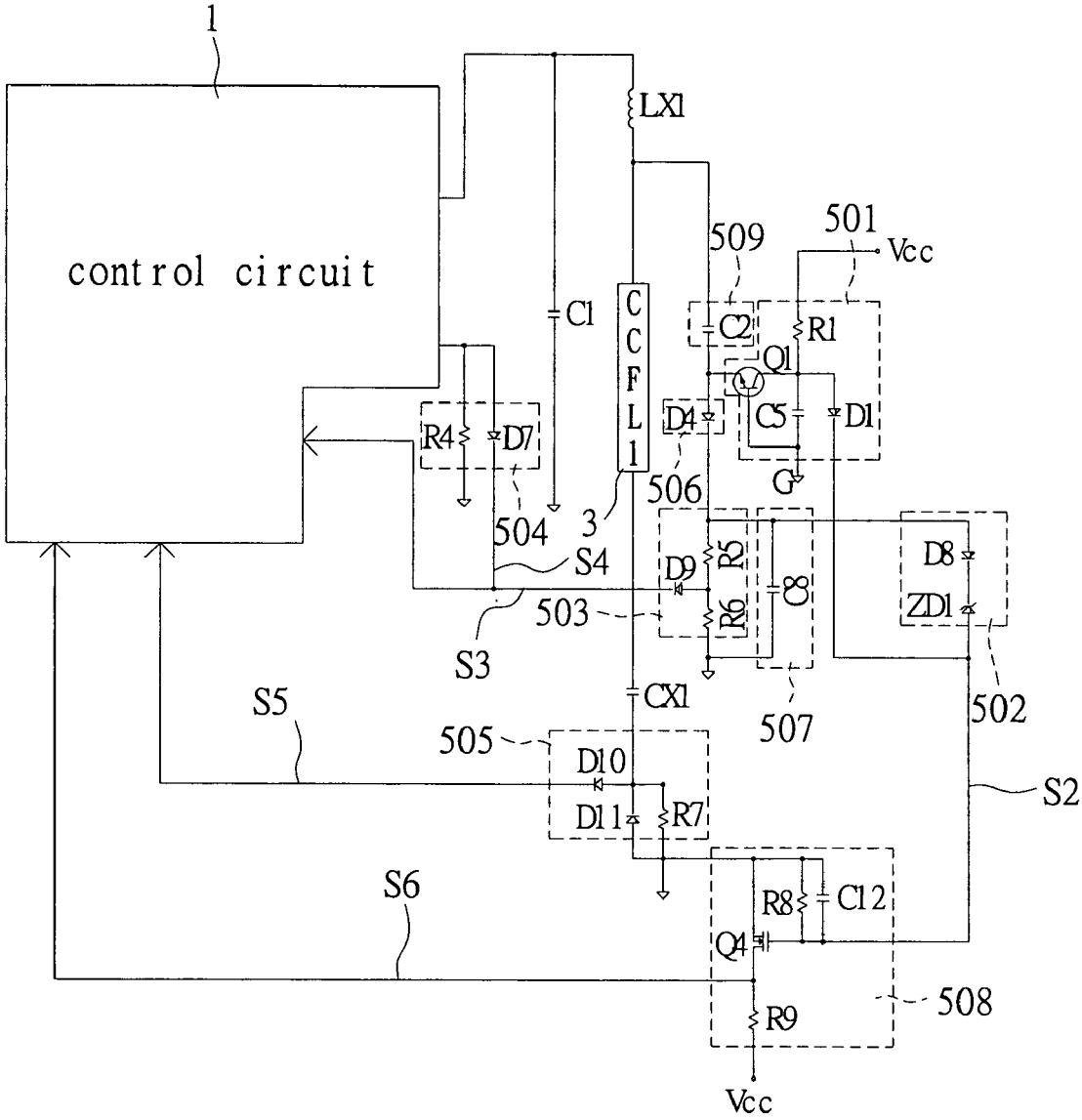
FIG. 4 is a detailed circuitry of the second preferred embodiment of the present invention.

Reference is made to the second preferred embodiment shown in FIG. 4 in view of FIG. 3, wherein the short detecting circuit 501 includes a transistor Q1, a second charging capacitor C5, a charging resistance RI, and a first forward diode D1. The transistor Q1 further has an emitter, a collector and a base, wherein the emitter couples to a high terminal of the CCFL 3, the base couples to a reference terminal G, and the second charging capacitor C5 couples to the reference terminal G and the collector of the transistor Q1, and the charging resistance RI couples to the power supply Vcc and the collector of the transistor Q1, and the first forward diode D1 couples to the collector of the transistor Q1.

The above-mentioned transistor Q1 of the short detecting circuit 501 is turned off as the CCFL 3 shorts, in the meantime, the power supply Vcc charges the second charging capacitor C5 via the charging resistance RI. After that, the short detecting circuit 501 outputs the short-circuit protective signal S1 to the signal-hybrid circuit 508 since the voltage depressed on the second charging capacitor C5 is bigger than the conducting voltage Vp of the first forward diode D1.

Reference is made to FIG. 4, the open detecting circuit 502 includes a second forward diode D8 and a Zener diode ZD1. FIG. 4 shows that the second forward diode D8 couples to the first charging capacitor 507, and receives a detecting voltage depressed on the first charging capacitor 507. Moreover, the Zener diode ZD1 couples to the second forward diode D8, wherein the open-circuit protective signal S2 is outputted to the signal-hybrid circuit 508 since the detecting voltage is bigger than a conducting threshold of the Zener diode ZD1. The lighting voltage-limited circuit 503 shown in FIG. 4 includes a third forward diode D9 and a voltage divider composed of a serial connection of a first resistance R5 and a second resistance R6. The voltage divider couples to the first charging capacitor 507 and divides the detecting voltage. The third forward diode D9 couples to a contact of the first resistance R5 and the second resistance R6, when the voltage across the mentioned contact is bigger than the conducting voltage of the third forward diode D9, the lighting voltage-limited circuit 503 outputs the over-voltage protective signal S3 to the control circuit 1.

Please refer to FIG. 4 in view of FIG. 3, the signal-hybrid circuit 508 is composed of the coupled capacitor C12, resistances R8, R9 and a MOS switch Q4. Moreover, the overload detecting circuit 504 is composed of the coupled diode D7 and resistance R4, and the current detecting circuit 505 is composed of the coupled resistance R7 and the diodes D10, D11.

Figure 5:
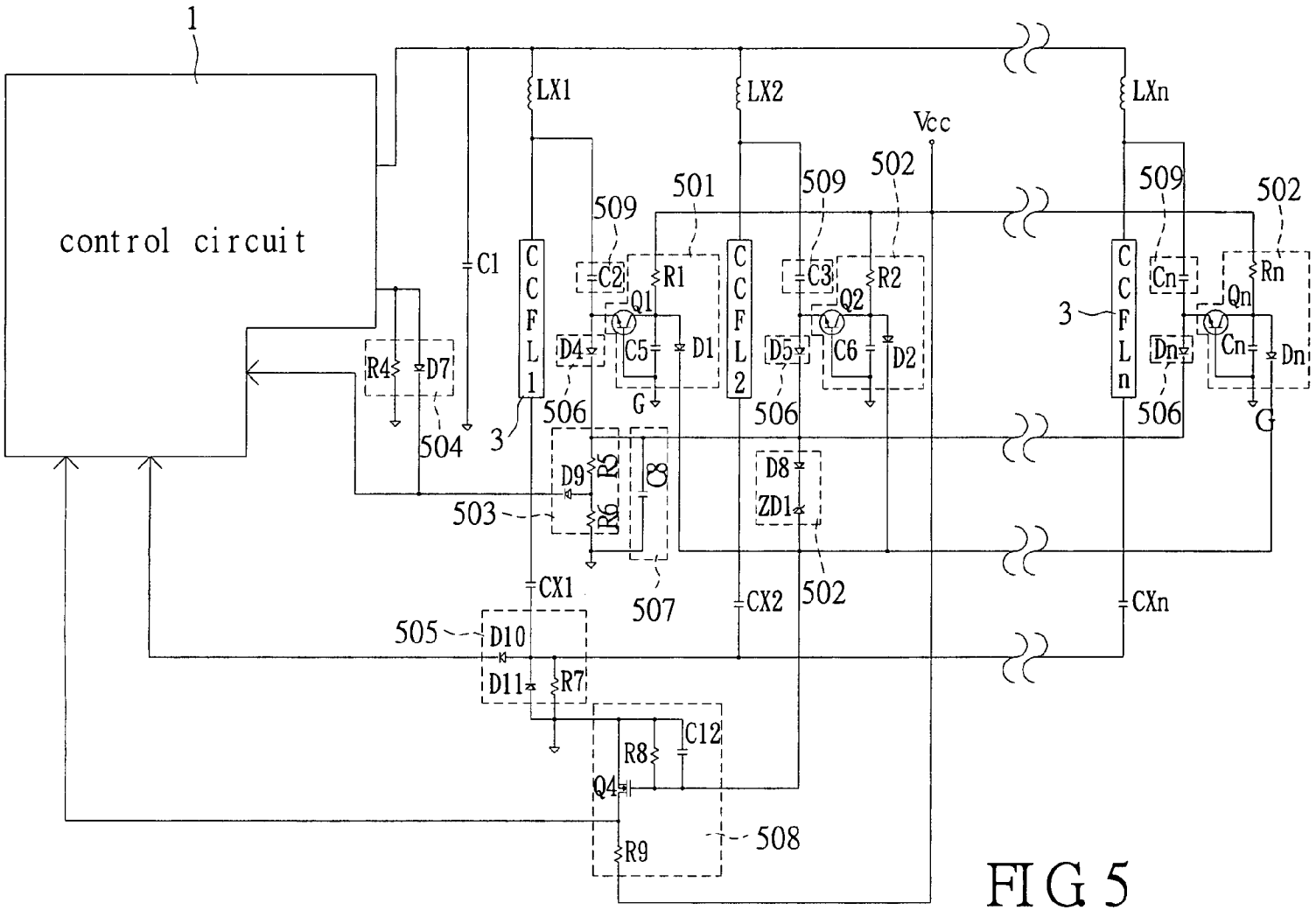
FIG. 5 is a detailed circuitry of a multiple-CCFL system of the present invention.

Reference is made to FIG. 5, which shows a schematic diagram of the detailed circuit of a multiple-CCFL system of the present invention. When the protective device 5 of the present invention is operated on the multiple-CCFL system, each of the CCFLs 3 simultaneously use the first charging capacitor 507, the open detecting circuit 502, the lighting voltage-limited circuit 503, the overload detecting circuit 504, and the current detecting circuit 505. However, each CCFL 3 also needs to couple a short detecting circuit 501, a step-down capacitor 509 and a rectified diode 506 as well. Moreover, each mentioned short detecting circuit 501 couples with the high terminal of each CCFL 3 and the power supply Vcc via the step-down capacitor 509, and each rectified diode 506 couples with the high terminal of each CCFL 3 via each step-down capacitor 509.

Figure 6:
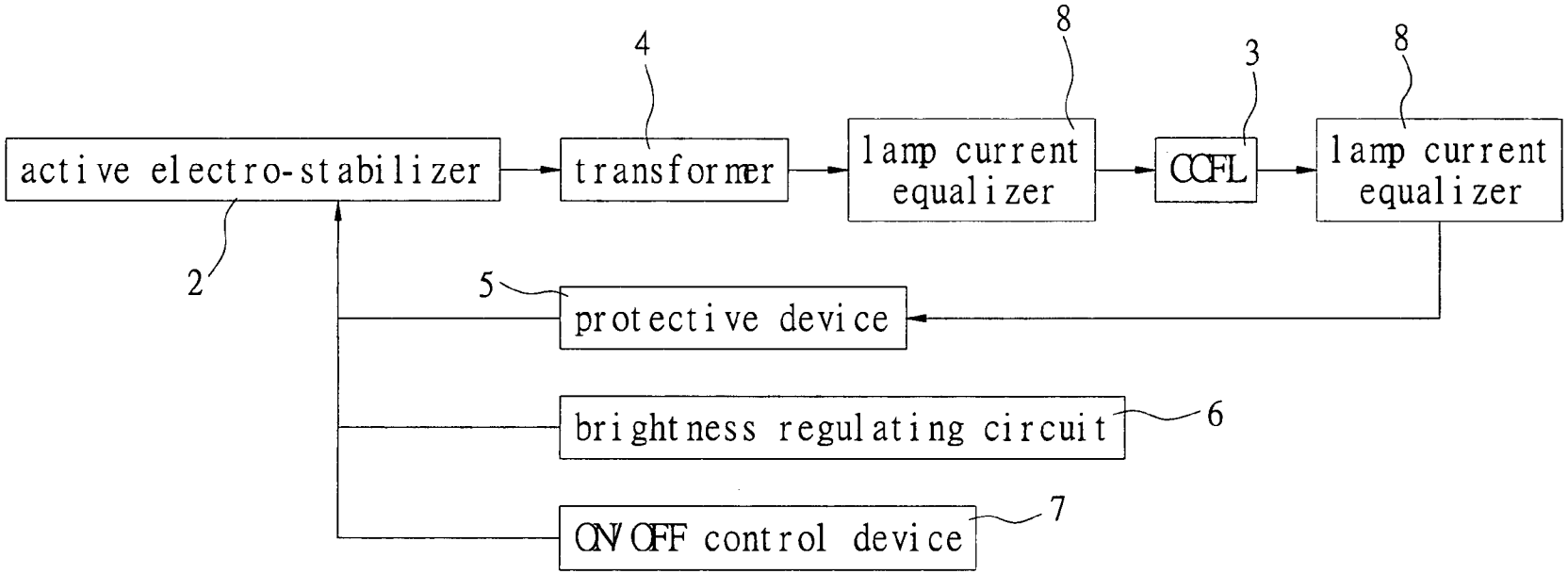
FIG. 6 shows a schematic diagram of a protective device being utilized in the CCFL driving system.

Referring to FIG. 6 in view of FIG. 2, FIG. 6 shows a schematic diagram of the CCFL driving system incorporating the protective device 5. The present invention further provides the shown CCFL driving system used for the protective device 5, wherein the CCFL driving system includes the protective device 5, a lamp current equalizer 8, a brightness regulating circuit 6, and an ON/OFF control device 7. Furthermore, the protective device 5 has a lighting voltage-limited circuit 503, an open detecting circuit 502, a short detecting circuit 501, an overload detecting circuit 504, and a current detecting circuit 505. In this embodiment, the CCFL driving system further utilizes an active electro-stabilizer 2 or a DC/high-frequency AC converter (not shown) to drive the plurality of CCFLs 3 through a transformer 4.

The aforementioned lamp current equalizer 8 couples to both terminals of the CCFL 3. One terminal is an inductive element, and the other is a capacitive element. Moreover, the sources of the signals detected from the lighting voltage-limited circuit 503, open detecting circuit 502 and the short detecting circuit 501 are the same. The signal detected from the overload detecting circuit 504 and the signal detected from the lighting voltage-limited circuit 503 are mixed, and a particular signal after the mixture is transmitted back to the active electro-stabilizer 2 via a feedback line (not shown in the diagram). Moreover, each CCFL 3 has its proprietary lighting voltage-limited circuit 503.

The above-mentioned ON/OFF control device 7 can be a transistor or an electro-optical coupler. The current detecting circuit 505 is used to detect the electrical signal of the CCFL 3, and the electrical signal is transmitted back to the active electro-stabilizer 2 via the feedback line (not shown in the diagram), so as to regulate the power of loading. The overload detecting circuit 504 is used to detect a current flowing a load, a terminal voltage of the load, or a resistance of the load.

From the above description, the feedback line is formed by an electro-optical coupler or a PCB copper foil, and the signal detected by the overload detecting circuit 504 and the signal detected by the lighting voltage-limited circuit 503 are transmitted back to the active electro-stabilizer 2 via the feedback line respectively.

To sum up, when the protective device 5 is operated on the multiple-CCFL system, the present invention provides a simplified circuit to protect the plurality of CCFLs. Therefore, the protective device 5 of the present invention efficiently improves the conventional scheme utilizing many protective circuits to protect the inverter and the CCFL of the multiple-CCFL system. The drawback of the conventional scheme includes:

1. high cost of manufacturing the LCD panel;
2. a complicated design of the protective circuit; and
3. a more difficult layout of the circuit.

While the invention has been described by means of a specification with accompanying drawings of specific embodiments, numerous modifications and variations could be made thereto by those skilled in the art without departing from the scope and spirit of the invention set forth in the claims.

What is claimed is:

1. A protective device used for a CCFL driving system, the protective device is used to protect a control circuit and a CCFL of the CCFL driving system, comprising:

(a) a short detecting circuit coupling with a high terminal of the CCFL and a power supply through a step-down capacitor, wherein the short detecting circuit receives a high AC power at the high terminal of the CCFL, and outputs a short-circuit protective signal to the control circuit when a shorting event occurs to the CCFL;

(b) a rectified diode coupling with the high terminal of the CCFL through a step-down capacitor, wherein the rectified diode rectifies the high AC power and outputs a high DC power;

(c) a first charging capacitor coupling with the rectified diode, wherein the first charging capacitor generates a detecting voltage based on the high DC power;

(d) an open detecting circuit coupling with the first charging capacitor and having a threshold, wherein the open detecting circuit outputs an open-circuit protective signal to the control circuit when the detecting voltage is greater than the threshold; and (e) a lighting voltage-limited circuit coupling with the first charging capacitor and receiving the detecting voltage, and outputting an over-voltage protective signal to the control circuit.

2. The protective device according to claim 1 further includes a signal-hybrid circuit coupling with the control circuit and a contact between the short detecting circuit and the open detecting circuit, wherein the signal-hybrid circuit receives both the short-circuit protective signal and the open-circuit protective signal, and outputs an open/short-circuit protective signal to the control circuit.

3. The protective device according to claim 2, wherein signal-hybrid circuit outputs the open/short-circuit protective signal to the control circuit through an electro-optical coupler or a PCB copper-foil.

4. The protective device according to claim 1, further including an overload detecting circuit, which outputs an overload protective signal to the control circuit in response to the current flowing across the CCFL.

5. The protective device according to claim 4, wherein the overload detecting circuit outputs the overload protective signal to the control circuit via an electro-optical coupler or a PCB copper-foil.

6. The protective device according to claim 4, further including a current detecting circuit, which outputs a power regulating signal to the control circuit in response to the current flowing across the CCFL.

7. The protective device according to claim 6, wherein the current detecting circuit outputs the power regulating signal to the control circuit via an electro-optical coupler or a PCB copper-foil.

8. The protective device according to claim 2, further including an overload detecting circuit, which outputs an overload protecting signal to the control circuit in response to the current flowing across the CCFL.

9. The protective device according to claim 8, wherein the overload detecting circuit outputs the overload protective signal to the control circuit via an electro-optical coupler or a PCB cooper-foil.

10. The protective device according to claim 8, further including a current detecting circuit, which outputs a power regulating signal to the control circuit in response to the current flowing across the CCFL.

11. The protective device according to claim 10, wherein the current detecting circuit outputs the power regulating signal to the control circuit via an electro-optical coupler or a PCB copper-foil.

12. The protective device according to claim 1, wherein the short detecting circuit outputs the short-circuit protective signal to the control circuit via an electro-optical coupler or a PCB copper-foil.

13. The protective device according to claim 1, wherein the open detecting circuit outputs the open-circuit protective signal to the control circuit via an electro-optical coupler or a PCB copper-foil.

14. The protective device according to claim 1, wherein the lighting voltage-limited circuit outputs the over-voltage protective signal to the control circuit via an electro-optical coupler or a PCB copper-foil.

15. The protective device according to claim 1, wherein the short detecting circuit comprises:

(a) a transistor having an emitter, a collector and a base, wherein the emitter couples to a high terminal of the CCFL, the base couples to a reference terminal;

(b) a second charging capacitor coupling to the reference terminal and the collector of the transistor;

(c) a charging resistance coupling to the power supply and the collector of the transistor;

(d) a first forward diode coupling to the collector of the transistor;

wherein, the transistor is off when a short occurs to the CCFL, and the power supply charges the first charging capacitor via the charging resistance, and outputs the short-circuit protective circuit when the first forward diode is on.

16. The protective device according to claim 1, wherein the open detecting circuit comprises:

(a) a second forward diode coupling to the first charging capacitor, and receiving the detecting voltage; and (b) a Zener diode coupling to the second forward diode, wherein the Zener diode is on when the detecting voltage is bigger than a conducting threshold of the Zener diode, so as to output the open-circuit protective signal to the control circuit.

17. The protective device according to claim 1, wherein the lighting voltage-limited circuit comprises:

(a) a voltage divider coupling to the first charging capacitor and dividing the detecting voltage, wherein the voltage divider is formed by a serial connection of a first resistance and a second resistance;

(b) a third forward diode coupling to a contact of the first resistance and the second resistance, and outputting the over-voltage protective signal to the control circuit.

18. A CCFL driving system of the protective device of the claim 1, comprising a lamp current equalizer, a lighting voltage-limited circuit, an open detecting circuit, a short detecting circuit, an overload detecting circuit, a brightness regulating circuit, a current detecting circuit, and an ON/OFF control device, wherein the CCFL driving system of a LCD panel drives a plurality of CCFLs simultaneously by utilizing an active electro-stabilizer or a DC/high-frequency AC converter through a transformer.

19. The CCFL driving system according to claim 18, wherein the lamp current equalizer couples to both terminals of the CCFL, one terminal being an inductive element, and the other being a capacitive element.

20. The CCFL driving system according to claim 18, wherein the sources of the signals detected from the lighting voltage-limited circuit, the open detecting circuit and the short detecting circuit, are the same.

21. The CCFL driving system according to claim 18, wherein the signals detected from the overload detecting circuit and the lighting voltage-limited circuit are mixed, and a signal after mixing is transmitted to the control circuit via a feedback line.

22. The CCFL driving system according to claim 18, wherein each CCFL has a proprietary lighting voltage-limited circuit.

23. The CCFL driving system according to claim 18, wherein the ON/OFF control device is a transistor or an electro-optical coupler.

24. The CCFL driving system according to claim 18, wherein the current detecting circuit is used to detect an electrical signal of the CCFL, and the electrical signal is transmitted back to the control circuit via a feedback line, so as to regulate the power of loading.

25. The CCFL driving system according to claim 18, wherein the overload detecting circuit is used to detect a current flowing a load, a terminal voltage of the load, or a resistance of the load.

26. The CCFL driving system according to claim 21 or 24, wherein the feedback line is composed of an electro-optical coupler or a PCB cooper foil.

27. The CCFL driving system according to claim 18, wherein the signal detected by the overload detecting circuit and the signal detected by the lighting voltage-limited circuit are transmitted back to the control circuit via a feedback line.

28. The CCFL driving system according to claim 18, wherein the control circuit is an active electro-stabilizer or a DC/high-frequency AC converter.

* * * * *